US005184969A

United States Patent [19]

Sharpless et al.

[11] Patent Number: 5,184,969

[45] Date of Patent: Feb. 9, 1993

[54] ELECTROLUMINESCENT LAMP AND METHOD FOR PRODUCING THE SAME

[75] Inventors: Edward N. Sharpless, Somerville, N.J.; Eugene W. McManus, Downingtown, Pa.

[73] Assignee: Electroluminscent Technologies Corporation, Horsham, Pa.

[21] Appl. No.: 601,827

[22] PCT Filed: May 30, 1989

[86] PCT No.: PCT/US89/02335

§ 371 Date: Nov. 1, 1990

§ 102(e) Date: Nov. 1, 1990

[87] PCT Pub. No.: WO89/12376

PCT Pub. Date: Dec. 14, 1989

Related U.S. Application Data

[63] Continuation-in-part of Ser. No. 200,616, May 31, 1988, abandoned.

[51] Int. Cl.[5] ..... H01J 9/02

[52] U.S. Cl. ..... 445/24; 313/505; 313/506; 445/25; 427/66

[58] Field of Search ..... 445/24, 25; 313/503, 313/505, 506; 427/66

[56] References Cited

U.S. PATENT DOCUMENTS

| | | | |
|---|---|---|---|
| 3,901,429 | 8/1975 | Boyer et al. | 228/6.2 |
| 4,015,166 | 3/1977 | Ohshima et al. | 313/503 |
| 4,104,555 | 8/1978 | Fleming | 313/512 |
| 4,396,864 | 8/1983 | Suntola et al. | 313/506 |
| 4,511,599 | 4/1985 | Rustomji | 445/24 |
| 4,532,454 | 7/1985 | Abdalla | 313/506 |
| 4,614,668 | 9/1986 | Topp et al. | 427/66 |
| 4,617,195 | 10/1986 | Mental | 427/66 |
| 4,626,742 | 12/1986 | Mental | 313/503 |
| 4,684,353 | 8/1987 | deSouza | 427/66 |
| 4,708,914 | 11/1987 | Kamijo | 428/690 |
| 4,721,883 | 1/1988 | Jacobs et al. | 313/505 |
| 4,956,031 | 9/1990 | Mori et al. | 313/506 |
| 5,118,987 | 6/1992 | Leksell et al. | 427/66 |

FOREIGN PATENT DOCUMENTS

| | | | |
|---|---|---|---|
| 1105267 | 4/1961 | Fed. Rep. of Germany . | |
| 2501195 | 7/1976 | Fed. Rep. of Germany . | |
| 2708451 | 8/1978 | Fed. Rep. of Germany . | |
| 2904016 | 8/1980 | Fed. Rep. of Germany . | |
| 3014840 | 10/1980 | Fed. Rep. of Germany . | |
| 0398991 | 3/1974 | U.S.S.R. | 313/506 |
| 89/12376 | 12/1989 | World Int. Prop. O. | 313/506 |

*Primary Examiner*—Richard K. Seidel
*Assistant Examiner*—Jeffrey T. Knapp
*Attorney, Agent, or Firm*—Synnestvedt & Lechner

[57] ABSTRACT

A flexible electroluminescent lamp assembly comprises a plurality of films, each film including a flexible plastic substrate and at least one electrically conductive layer. In one embodiment, a first light-emitting film is arranged between two other films and includes an electroluminescent layer and a light-transmissive conductor. The second and third films provide busbar and back electrodes, respectively. Alternatively, flexible electroluminescent lamp assemblies may be produced by securing between two plastic substrates back electrode, optional dielectric layer, electroluminescent layer, light-transmissive conductor, and busbar in that order. The films are produced independently and then laminated together to provide one or more lamps.

15 Claims, 7 Drawing Sheets

FIG. 1
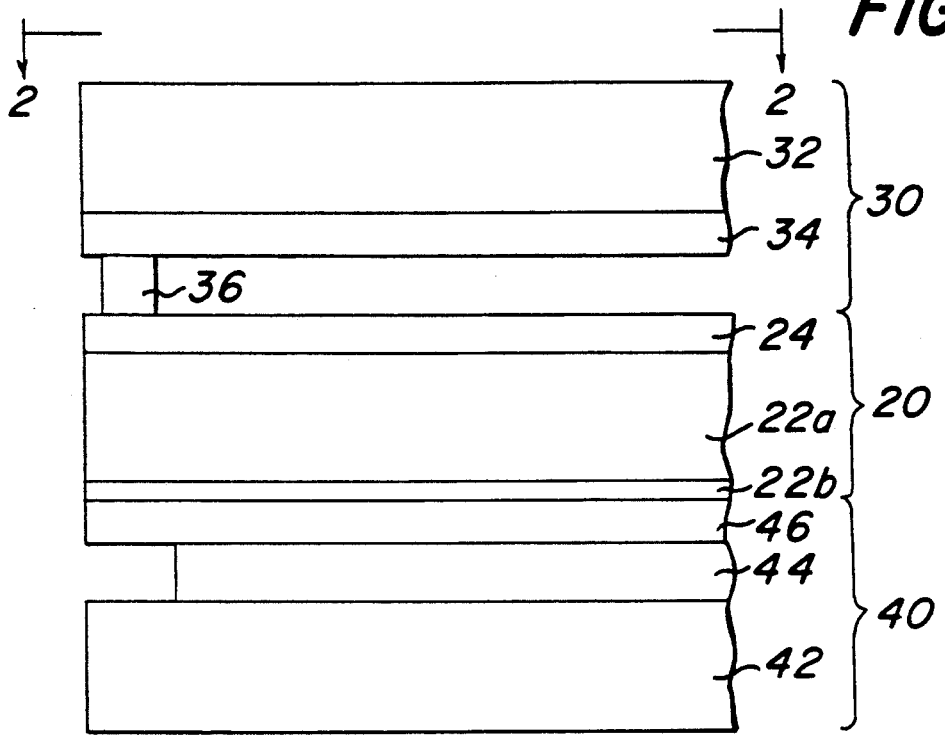
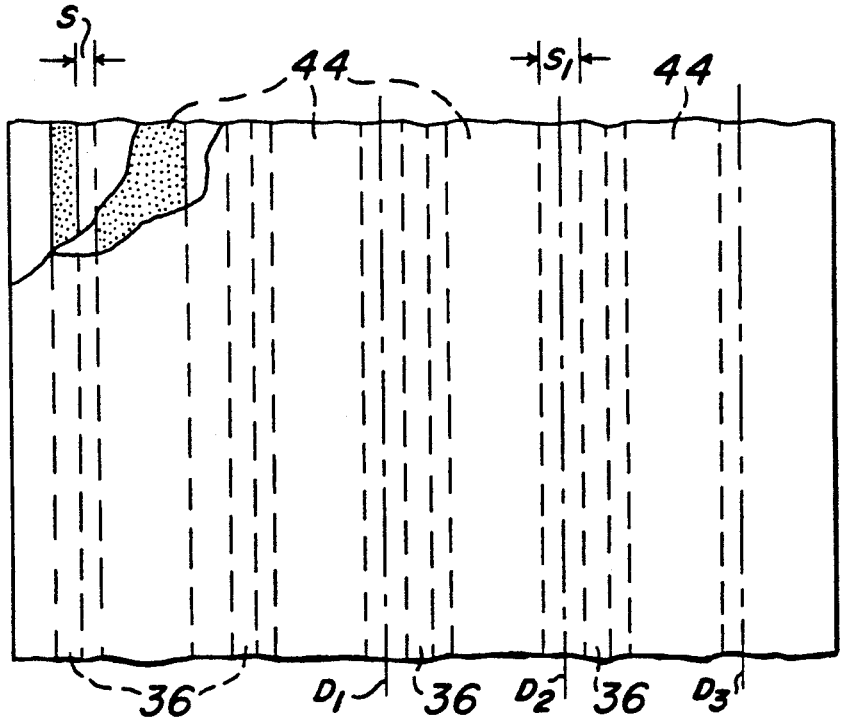
FIG. 2

FIG. 3
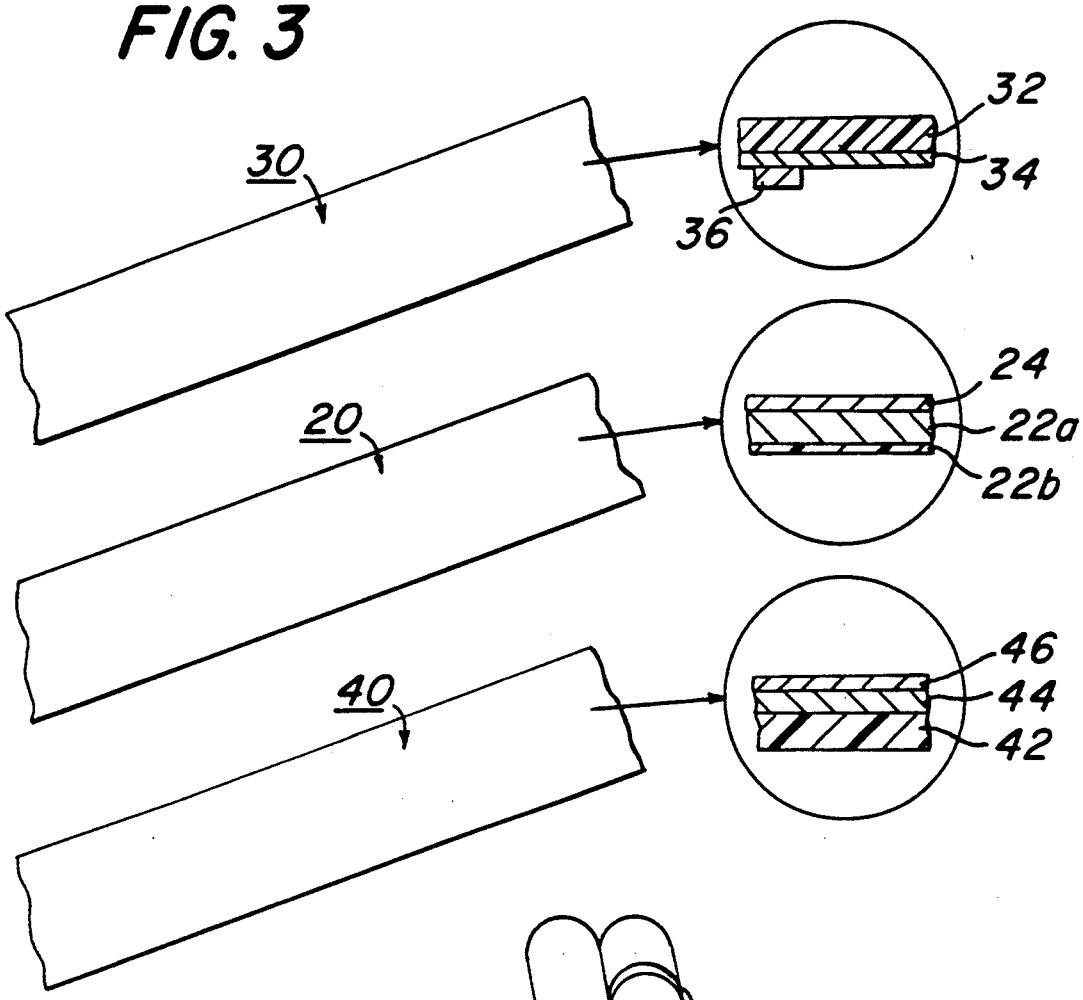
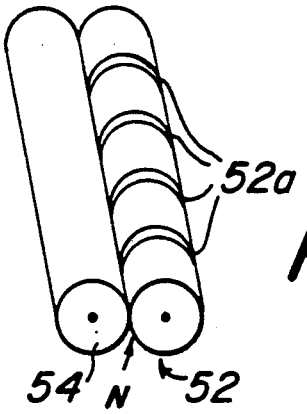
FIG. 5
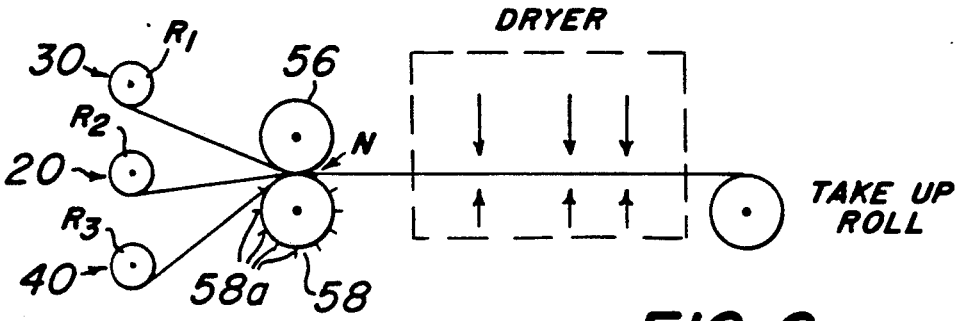
FIG. 6

FIG. 4
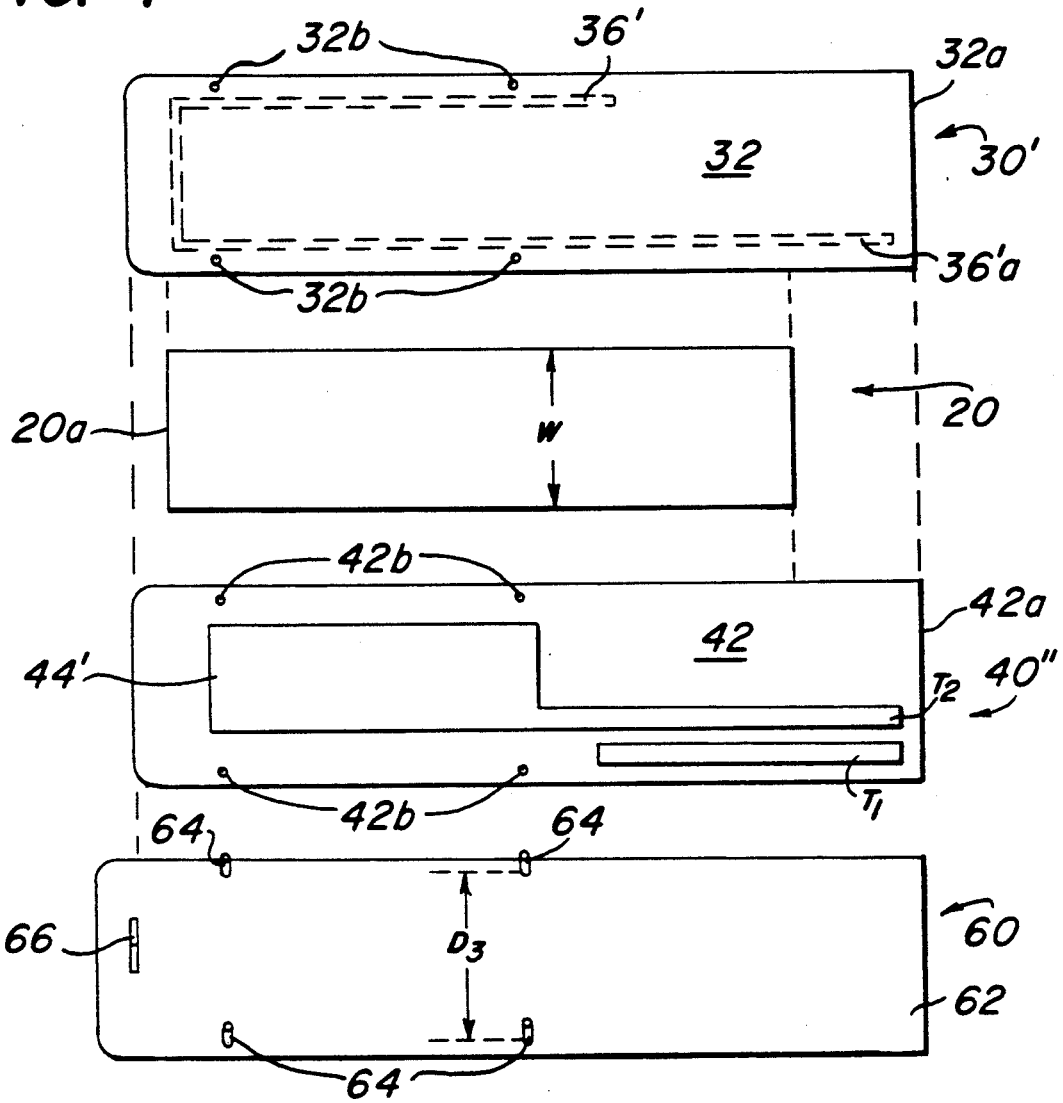
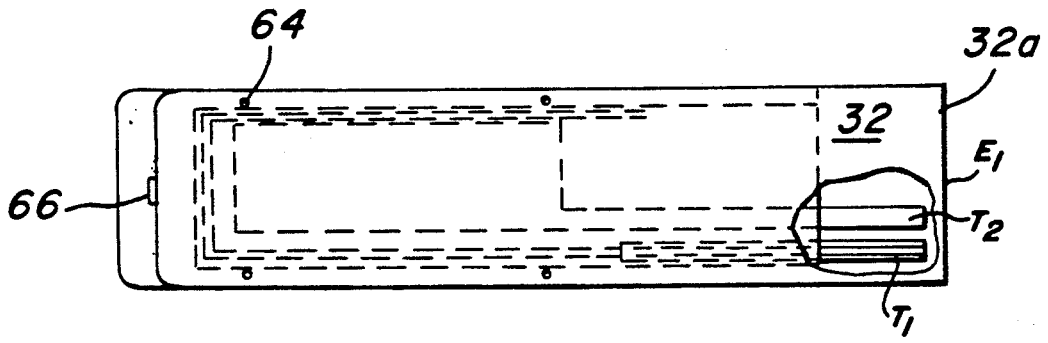
FIG. 4A

ELECTROLUMINESCENT LAMP AND METHOD FOR PRODUCING THE SAME

This application is a continuation-in-part of Ser. No. 07/200,616, filed May 31, 1988, now abandoned.

BACKGROUND OF THE INVENTION

The present invention relates to electroluminescent lamps and to methods for producing them. The electroluminescent lamps are comprised of a plurality of separate films having two major surfaces, each film including one or more layers, beginning with a flexible plastic substrate. Laminating the aforesaid films under heat and/or pressure yields effective electroluminescent lamps through the employment of greatly simplified and less critical production techniques.

Flexible electroluminescent (EL) devices are well known the art. For example, U.S. Pat. No. 4,684,353 discloses a flexible electroluminescent device including a flexible plastic dielectric substrate which is successively provided on one major surface thereof with an electroluminescent layer, a light-transmissive conductive layer, and a layer comprised of a bus electrode; in addition thereto, the opposite major surface of the plastic substrate is provided with a back electrode.

Each of these four layers is formed by successively passing the plastic substrate through appropriate coating equipment. In the production of a lamp having multiple coatings or layers, it is not uncommon to encounter registration problems which, if not resolved, lead to a considerable waste of time, money, material, and effort. This is especially so in the case of the electroluminescent and light-transmissive materials, which are the two most expensive materials employed in the laminated product.

In addition, the plastic substrate of the example given above undergoes a minimum of four coating operations which greatly increase the handling of the substrate as well as increasing the possibility of introducing production problems which will result in a defective and useless product.

Furthermore, the product produced according to the teachings of U.S. Pat. No. 4,684,353 lacks good dimensional stability and, prior to being encapsulated, does not afford protection for the electroluminescent phosphor which is sensitive to moisture; nor does it afford protection of the electrodes from contamination or oxidation.

Thus, it is an objection of this invention to provide solutions to the aforesaid production problems, while also providing a new and improved electroluminescent lamp.

BRIEF DESCRIPTION OF THE INVENTION

In solving the various deficiencies associated with the known electroluminescent devices and their manufacture, this invention presents electroluminescent lamp and process aspects.

As to the process aspect, the invention is characterized by a method for producing flexible EL devices wherein the number of handling and/or coating steps performed on any given plastic substrate is significantly reduced, and wherein registration problems are confined to those layers which are least expensive to produce.

As to the electroluminescent lamp aspect of the invention, the lamps produced in accordance with the method of the present invention have excellent dimensional stability, afford excellent protection of the busbar and back electrode from oxidation, and provide a highly flexible structure from which lamps can be cut, stamped, perforated, and printed upon without any additional surface treatment, while at the same time providing lamps having an extremely long operating life and a high illumination level.

In a preferred embodiment, one major surface of a first thin plastic dielectric substrate is coated with an electroluminescent phosphor. Although the aforementioned U.S. Pat. No. 4,684,353 discloses a preferred coating technique, any other suitable technique may be employed. A thin transparent, semi-transparent, or translucent (herein "light-transmissive") layer of electrically conductive material, which serves as a front electrode, is then applied over the exposed surface of the electroluminescent phosphor layer.

A second flexible, light-transmissive, thin gauge plastic substrate is then, optionally, coated in an independent operation on at least a part of one major surface thereof with a suitable light-transmissive adhesive layer, preferably of the heat sealable type. An electrically conductive busbar is coated over at least a portion of the exposed surface of the substrate or adhesive layer.

A third flexible, thin gauge plastic substrate is at least partially coated or covered on one major surface thereof in an independent operation with a back electrode layer. An adhesive layer is then optionally applied upon any exposed, uncoated surface of the substrate as well as the back electrode.

The busbar and back electrode, formed, respectively, on the second and third plastic substrates, are carefully controlled as to size and orientation on their respective substrates and are preferably aligned in registry with at least one edge of the associated plastic substrate. The edges may be held in alignment mechanically, but optical sensors reading the film or electrode edges will assure registration.

The above-mentioned films are then laminated together, e.g., employing heat and/or pressure, with the films being aligned so that the busbar is in electrical contact with the front electrode, i.e. the light-transmissive conductive layer, and so that the back electrode is joined with the remaining major exposed surface of the plastic substrate supporting the electroluminescent phosphor layer.

The second and third, i.e., outer, films having the busbar and back electrode, respectively, are preferably brought into registry by edge alignment or optical alignment of the longitudinal edges of the conductive strips on the plastic substrates. Another method of alignment is accomplished by optically sensing the back electrode and positioning the busbar, in which case there need be no actual edge alignment of the films. Alternatively, the second and third films are provided with mechanical alignment means, e.g., holes along the edges through which alignment pins fit when the holes in the films are in register. There are no registry problems whatsoever with respect to the first, middle film, since the electroluminescent phosphor and light-transmissive conductive coatings are substantially completely coincident with each other and with the plastic substrate and thus have no unique orientation of one layer relative to the other, whereby the problem of misregistration of the first film within the resulting laminated product is eliminated.

The optional adhesive layer and busbar applied to the second plastic substrate are preferably applied by a gravure technique. The conductive material for the busbar may, for example, be a conductive ink such as a silver ink. The thickness of the adhesive layer is a function of the cost and desired transparency of the adhesive, as well as the bond strength required.

The back electrode and optional adhesive are applied to the third plastic substrate in a substantially similar manner to that used to produce the second film incorporating the busbar. Alternatively, the back electrode may be applied via a knife over roll method, transfer roll, or conventional coating and in-line printing methods. As a further alternative, the back electrode and adhesive and/or the busbar and associated adhesive may be applied in reverse order from that previously described.

In a preferred technique for producing the aforesaid embodiment, the second, top substrate is adhesive coated, dried and wound up into a roll. A silver ink busbar is then applied and dried, and the second, top film is wound into a roll. The third, bottom plastic substrate is silver ink-coated, dried and rewound. The adhesive is then coated, and the third film is rewound. Both second and third film rolls are then ready for the lamination process.

Since certain conductive inks, e.g., silver inks, contain sufficient resin to adhere the third film containing the back electrode to the plastic substrate of the first, middle film, the adhesive coating otherwise applied to the film containing the back electrode may be omitted if desired when such inks are used. It is also possible to omit the adhesive layer otherwise provided in the second film incorporating the busbar, especially in applications where two or more spaced parallel busbars are provided in the final product, the resin in the silver ink again can function as an adhesive.

As still another alternative embodiment, the process for producing the first, middle layer incorporating the electroluminescent coating may be totally eliminated. The adhesive coating in the third film incorporating the back electrode may be eliminated, and the electroluminescent coating may be deposited directly upon the back electrode. Thereafter the conductive light-transmissive layer may be coated directly upon the electroluminescent coating, thus increasing the number of coating steps on the third substrate to a total of three, while totally eliminating the need for a first film of the type employed in the preferred embodiment described above and, more importantly, eliminating one adhesive coating step and one plastic substrate. It should be borne in mind, however, that the aforesaid alternative requires that the dielectric strength of the electroluminescent layer is high enough to support the electric field applied across it.

In important variants of the aforesaid embodiments, a dielectric layer, other than the plastic substrate mentioned above, can be interposed between the back electrode and the electroluminescent phosphor layer. For example, the dielectric layer can be introduced as a coating, rather than as the free-standing plastic substrate. As another variant, the back electrode can be a free-standing, flexible, conductive foil, such as aluminum foil, rather than a coating.

When all of the films to be utilized in the finished product have been completed, lamination is performed by aligning the two outer films, i.e. the films containing the busbar and back electrode, respectively, which alignment can be accomplished by an edge guide or by alignment through the use of optical sensors. The films to be laminated can be passed through the nip of a pair of heatable pressure rollers, and the layers subjected to a temperature in a range from about 100° to about 350° F. when hot melt adhesives are employed. The rollers preferably comprise a heated roller and a cooperating pressure roller. The elevated temperature activates the heat sealable adhesive. After lamination, the completed product is rolled on a take-up roll.

The completed product, i.e., any of the lamp embodiments described hereinabove, preferably utilizes films which are in the form of elongated sheets that can be rolled and processed on conventional web-handling equipment. The product preferably incorporates a plurality of spaced, parallel, elongated lamp structures. Each of the spaced, parallel lamp structures may be cut away from the others. Lamps of any desired length may be provided by cutting each of the individual elongated lamp strips to the desired length. Individual lamps may be adapted for connection to a power source by coupling connector terminals to the lamp structure. Completed lamp structures may be encased in a suitable vapor barrier, resistant envelope which may, for example, be formed from a suitable vapor resistant material, such as a halocarbon resin.

As described in detail hereinafter, the production method of this invention eliminates the need for the use of integral electrical connection tails, which must be separately produced, and which further require providing adhesive coatings thereon to properly adhere the metal-to-metal contacts of the lamp and the associated tails.

Individual lamps may be produced through a laminating process similar to that described above. The electrodes utilized to produce small lamp structures can be printed upon plastic sheets in a pattern incorporating a plurality of such electrodes, which electrodes can either be cut out and then used in the assembly process or, alternatively, can first be assembled with the other layers, whereupon the individual lamps may then be cut away from the large sheet and provided with clincher-type terminals, for example, and vapor resistant layers, if desired.

Although the back electrode is advantageously formed of a conductive ink as described above for many applications, it may alternatively be formed of a metal per se, e.g., flexible metallic foils, such as aluminum, or vapor-deposited thin films which may be produced thermally or by cathode sputtering, for example. In this regard, vapor-deposited aluminum (VDAL) is inexpensive and conveniently employed. The VDAL or other back electrode may be provided as a coating on the third plastic substrate or on the rear surface of the first substrate supporting the light emitting layer. The VDAL may be deposited as a continuous layer entirely coating its associated substrate or, alternatively, may be formed into strips or other patterns. The VDAL provides a conductive back electrode which is significantly lower in cost than a silver electrode.

Any flexible, electrically conductive, chemically stable, and light-transmissive material may be employed as the conductive layer contacting the electroluminescent phosphor layer. The conductive layer can be applied by solvent coating or from the vapor phase, for example.

VDAL, and the other materials mentioned above in connection with back electrode materials, may be used to produce the busbar. In this role, conductors such as metal, including VDAl, or metal oxides may be directly deposited onto the transparent conductive layer or separately coated onto a thin film, slit to a strip, and then laminated to the light-transmissive conductive layer.

BRIEF DESCRIPTION OF THE DRAWINGS

FIG. 1 is an enlarged, diagrammatic, partial end view of a plurality of films formed and arranged in accordance with the principals of the present invention.

FIG. 2 is a plan view taken along line 2—2 in FIG. 1 and which includes the laminated structure of FIG. 1.

FIG. 3 is a simplified exploded view of the layers making up the laminated lamp of FIGS. 1 and 2.

FIG. 4 is an exploded view of the combination registration and lamination means utilized to produce individual lamp structures.

FIG. 4*a* is a plan view of the arrangement shown in FIG. 4.

FIGS. 5 and 6 are simplified diagrammatic views useful in explaining some of the techniques which may be used to practice the present invention.

DETAILED DESCRIPTION OF THE INVENTION

Figure 7:
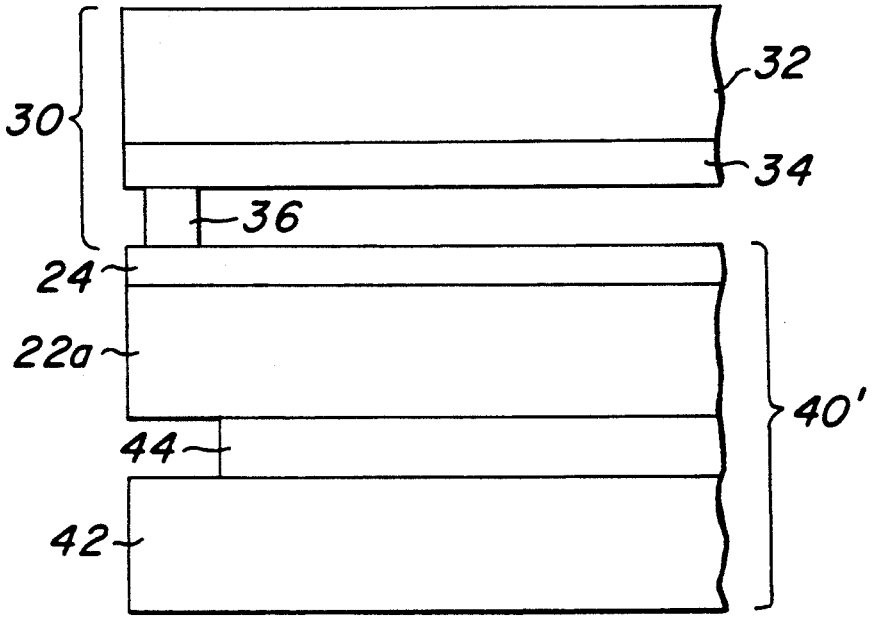
FIG. 7 is an enlarged, diagrammatic, partial end view of an alternative lamp embodiment of the present invention.

FIGS. 1-3 show a preferred embodiment of the lamp assembly of this invention. FIG. 1 is a greatly enlarged view of one of the preferred embodiments of the present invention which comprises a structure formed of films 20, 30 and 40 which contain various layers and are laminated together, preferably by heat and pressure, in a manner to be more fully described hereinafter. Each of the individual layers and the manner of its formation will now be described.

First film 20, which is the center or middle film of the laminated structure, may be a commercially available product, such as set forth in U.S. Pat. No. 4,684,353. The film 20 is preferably formed of a suitable flexible substrate 22*b*, such as polyethylene terephthalate (PET), for example, and carries a layer of light-emitting, electroluminescent phosphor-containing material 22*a*. A light-transmissive conductive layer 24, e.g., metal oxide, is deposited upon layer 22*a*. Layer 24 serves as a light-transmissive top electrode for the lamp. In an important variation, substrate 22*b* can be a suitable coated dielectric material, rather than a free-standing plastic film, as described hereinafter.

The transparent conductive layer referred to throughout the description of the invention is preferably formed of indium tin oxide (ITO) ink or indium oxide (IO) ink, which is typically ITO or IO in a resin and can be solvent-coated, but other well known equivalents can be employed. At the thickness desired, these inks are not completely transparent. Functionally equivalent materials include metals, such as silver, gold, and aluminum, and metal oxides, such as tin and indium oxides, for example. Such materials can be applied from the vapor phase by well known evaporation or cathode sputtering techniques. For example, vapor-deposited aluminum (VDAL) may be employed as the conductive, light-transmissive electrode.

A detailed description of the structure, composition and techniques employed for producing film 20 are set forth in U.S. Pat. No. 4,684,353, and the descriptions in the aforesaid patent are incorporated herein by reference thereto. It is sufficient for purposes of the present invention to understand that the film 20 is formed by passing the plastic substrate 22*b*, which is preferably 0.25 mils thick in one preferred embodiment, through suitable coating means for application of the light emitting layer 22*a*, after which the substrate with the light emitting layer is air dried, generally in a heated oven, and rolled up. Thereafter, a second coating operation is performed, whereupon the conductive layer 24 is applied thereto. The light-transmissive conductive coating may be evaporated or sputtered directly onto layer 22*a* or may be coated in a resin. In the latter case, the layer is then air dried and the completed film is then wound up in preparation for the lamination process.

Second film 30 is comprised of a flexible plastic substrate 32, which may preferably be PET two mils thick. The PET layer may, if desired, be in a range from about 0.25 to 5 mils thick. If desired, commercially available polyesters in a range from 2 to 25 mils may alternatively be employed for substrate 32.

Although other flexible plastic substrates can be utilized, polyesters, e.g., PET, are a preferred choice for substrate 32 in many instances due to their excellent transparency characteristics and dimensional stability. Plastic substrate 32 can also be translucent if desired, and it may be substantially colorless or deliberately dyed to be colored. If substrate 32 is colored, the light emitted from the electroluminescent lamp will be correspondingly affected. Other types of plastic substrates which can be employed in any of the films include various thermoplastic films, such as polyolefins, e.g., polyethylene, poly(haloethylene), or polypropylene; cellulose derivatives, e.g., cellulose acetate; vinyl polymers, such as poly(vinyl chloride); acrylic polymers, e.g., acrylate or methacrylate esters; as well as copolymers including monomers similar to those cited. Among these various alternatives, poly(haloethylenes), such as poly(trichlorofluoroethylene) are especially attractive, because of their low vapor transmission rates. Such plastic film substrates are available in commerce; e.g., ACLAR is a trademark of Allied Chemical Co., and KEL-F is a trademark of 3M Co. for such materials.

An adhesive layer 34 is optionally formed on one major surface of plastic substrate 32. The adhesive can be either hot melt or solvent coated. The preferred class of adhesives is heat sealable adhesives having an activation range of the order of about 100° to about 350° F.

The adhesives employed are preferably polyester adhesives such as, for example, the National Starch Duro Lam 30-9103 adhesive. However, any other adhesive may be employed which is suitable for joining film 30 to film 20. The above objectives and materials are also appropriate for the adhesive employed in film 40, as will be more fully described hereinbelow.

For certain lamp applications it may be advantageous to include a dye in the adhesive in order to control the color of the light emitted from the lamp. Adhesive thickness is preferably in a range from about 0.001 to about 10 mils, with the thickness selected being a function of bonding strength and opacity, it being understood that since the light from the lamp will pass though film 30 it is desirable to minimize the opacity of the adhesive layer.

A variety of coating techniques may be employed to apply the adhesive 34 to plastic substrate 32, including the gravure technique, the Mayer rod technique, and the reverse roll-offset technique. The gravure technique is the preferred technique and employs a gravure roller which, together with a second roller forms a nip through which plastic substrate 32 passes.

As a further alternative, the adhesive employed may be of the pressure sensitive type. Pressure sensitive adhesives have the disadvantage, as compared with heat sealable adhesives, of requiring a protective cover sheet in the event that the web is wound up prior to performance of the next step in the lamp producing process. The protective strip may be eliminated if the layer is directly fed to the laminating station.

The adhesive is applied to the plastic substrate 32 which is preferably in the form of an elongated web passing through the coating nip. The coated substrate is passed through an oven to be dried, and the web is rewound in preparation for application of the busbar 36. The busbar 36 is preferably formed of silver and may be applied directly to the adhesive using a smooth gravure roller having circular cuts or channels arranged at spaced longitudinal intervals about the surface of the gravure roller with the width and spacing of the aforesaid channels being selected according to the desired width and spacing between the busbars 36 as shown in FIG. 2. FIG. 5 shows a gravure roller 52 forming a nip N with a smooth roller 54. Gravure roller 52 is provided with the plurality of grooves or channels 52*a* having a width and interval spacing selected to obtain a desired width and spacing of the busbars 36 in applications where it is desirable to form a plurality of individual laminated lamps across the width of the film 30.

The busbar layer 36 is preferably formed of a conductive ink such as a silver ink. One suitable commercially available silver ink is produced by the Olin Hunt Corporation and identified by the designation ADVANCE 725A. The silver ink is preferably modified by dilution with 10 to 15 percent cyclohexanone. The silver ink and cyclohexanone are thoroughly mixed and the resulting homogenous composition is delivered to the channels 52*a* of gravure roller 52 for forming spaced strips of the type shown as layers 36 in FIG. 1 along the film 30, as also shown in FIG. 2. The gravure process does not require any special temperature conditions and may be employed at room temperature.

Although the ADVANCE 725A silver ink has been found to provide a flexible busbar having good conductivity, other silver inks may be employed. Such silver inks are available from Olin Hunt Corporation, DuPont Corporation and Acheson Colloids Incorporated as well as numerous other producers of silver ink. Alternatively, other conductive inks or conductive liquids may be employed, such as graphite-containing inks, as well as blends of silver and graphite. In addition, vapor-deposited metals or metals deposited by chemi-deposition can be utilized. Selection of the conductive material is tempered by a requirement for good adhesion.

No surface treatment is usually required preparatory to coating the busbar 36 upon the adhesive layer 34. In addition, since the busbar 36, in one preferred embodiment, contains resin which will adhere to the surface of layers 24 and 32 using a lamination process employing heat and pressure, the adhesive layer 34 may be omitted, especially in those instances where a plurality of spaced parallel busbars 36 are provided in film 30. This lamination process is then similar to the above-mentioned process but frequently employs higher temperatures and longer dwell times which are dependent upon the resins used by the manufacturers in the production of their conductive materials. However, the films 20 and 30 may come apart in the regions containing no busbar when the individual lamp strips are cut away from the laminated webs.

As the busbar(s) is(are) formed on the substrate 32 or upon the adhesive 34, the film 30 is passed through an oven to be air dried and then rolled up in readiness for the final lamination process.

Third film 40 is preferably comprised of a 2 mil thick, flexible PET plastic substrate 42 chosen due to its excellent stability and flexibility characteristics. However, any other suitable plastic material may be employed, such as those mentioned hereinabove. The substrate 42 need not be transparent or even translucent and may be opaque, since light is emitted through the film 30.

A back electrode layer 44, which may be silver ink, is formed on one major surface of substrate 42. Back electrode 44 may be formed utilizing the same composition used to form the busbar 36 of film 30. A slotted knife reverse roll technique is preferably utilized to apply the back electrode layer directly to substrate 42. No surface treatment of substrate 42 is required ordinarily preparatory to application of the back electrode 44.

The slotted knife reverse roll technique employs a knife provided with slots having a width and spacing relative to the adjacent slots to form back electrodes 44 of a width and spacing as shown, for example, in FIG. 2.

After the coating forming the back electrode(s) is applied, the web is passed through an oven and air dried. Substrate 42 with layer 44 is then either rolled up preparatory to the next coating operation or, alternatively, the web may pass directly through an adhesive application station. The size and shape of the back electrode determines the size and shape of the light emitting area, so it will be evident that various lighted patterns can be created thereby.

The application of adhesive layer 46 to back electrode 44 is preferably similar to the techniques employed for coating substrate 32 with adhesive layer 34. In addition, the class of adhesives and thicknesses utilized are preferably chosen in the same manner as outlined hereinabove for adhesive layer 34. Electrode 44 requires no surface treatment preparatory to receiving the adhesive layer. The opacity of the adhesive layer is not of great concern, since light is not normally emitted through electrode 44, but the layer should be as thin as possible.

As an alternative, the adhesive layer 46 may be totally eliminated if desired, provided there is sufficient resin in back electrode 44, e.g., silver ink, to adhere film 40 directly to film 20. the adhesive layer can be eliminated in the production of film 40 since the back electrode 44 typically has sufficient surface area to provide good adhesion between back electrode 44 and the adjacent plastic substrate of film 20. On the other hand, only where film 30 is formed with a plurality of silver busbars 36 (note FIG. 2) should the adhesive layer 34 be eliminated. If film 30 includes a single busbar, the laminated films 20 and 30 would pull apart due to the large unbound surface area between layers 24 and 34.

As another alternative, either or both of back electrode layer 44 and adhesive layer 46 can be applied to first plastic substrate 22*b*, rather than to third plastic substrate 42. Also, the order of forming the adhesive and silver busbar layers 34 and 36 upon plastic substrate 32 may be reversed, if desired, the adhesive layer generally being of a thickness which does not have a significant effect on the electrical conductivity path between conductive layer 24 and busbar 36.

The final lamination process preferably is performed by placing each of the completed films 20, 30 and 40 upon rotatable supply rollers $R_1$–$R_3$ for delivering the webs to a pair of nip rollers 56 and 58 as shown in FIG. 6. One of said rollers typically is a hot roller and is preferably formed of a resilient compressible material or of a metallic core material having an outer layer of a resilient compressible material or other suitable roller composition. The nip N is maintained under pressure by urging the rollers toward one another. The hot roller generally is heated to a level sufficient to maintain a temperature in the range between about 100° to about 350° F. to activate the heat sealable adhesive(s).

Preparatory to lamination, the films 30, 20 and 40, arranged on feed rollers R1, R2 and R3, respectively, are brought into proper registry by aligning the film edges, or the conductive strips of films 30 and 40. There is no criticality in the alignment of the intermediate film 20 relative to films 30 and 40, since the phosphor and light-transmissive conductive layers 22*a* and 24, respectively, generally are coextensive with the width of their associated substrate. Alternatively, the films 30 and 40 may be aligned by employing an edge guide arranged along one edge, such as, for example, a left hand edge, of the laminating equipment. Other means of controlling film alignment have been described earlier. The resulting laminated structure is then wound up upon a take-up roll.

The resulting product, which includes layers of three plastic substrates, exhibits excellent dimensional stability. The substrates 32 and 42 serve to protect the busbar and back electrodes 36 and 44, respectively, and prevent these electrodes from oxidizing, which is extremely important.

The finished product is flexible and can be cut, stamped and perforated with ease. Either of the exposed surfaces of layers 32 and 42 can be printed upon without any additional surface treatment. Printing on either exposed surface may be performed using a gravure or offset technique, and the exposed surfaces may even be painted using paint applied directly to the exposed surface by spraying or even by an artist's brush. The layers 32 and 42 serve as excellent substrates for use with light-transmissive inks.

In addition to the use of clear transparent film to form layers 32 and 42, as mentioned hereinabove, the film can be dyed or mixed with a dye to produce light of different colors. If desired, the dye may also be added to and mixed with the adhesive, e.g., adhesive 34. The film may be either transparent or translucent, if desired. Since the back electrode 42 generally renders back layer 40 substantially opaque, the dye need only be admixed with either layer 32 or adhesive 34 or both, if desired.

FIG. 2 shows the completed laminated structure of which FIG. 1 is a part. The busbars 36 and the back electrodes 44 are arranged in spaced parallel fashion and are substantially parallel to the longitudinal direction of the web. Electrodes 36 and 44 are non-overlapping. The spacing S between adjacent front and back electrodes is preferably of the order of 0.050 inches. However, any other suitable spacing may be employed if desired. The spacing $S_1$ between the left-hand edge of each busbar 36 and the right-hand edge of the back electrode associated with the next lamp may be significantly greater than spacing S and is utilized to sever adjacent lamp strips from one another. For example, the two right-hand-most lamp strips may be severed from the composite web by cutting along dotted lines $D_1$ and $D_2$. The right-hand portion of the right-hand-most strip may be trimmed by cutting along line $D_3$, for example, so as to provide elongated lamp strips of substantially uniform width.

After the lamination and cutting operations have been performed, each of the individual elongated strips may be cut to any desired length and electrically coupled to a suitable power source, for example, through the employment of a puncture connector such as, for example, a Berg clincher-type connector produced by DuPont. Other connectors such as pressure type insertion type connectors can be used for establishing an electrical connection between the lamp and a power source. The lamp is advantageously designed to be powered by a conventional 115 volt 60 cycle AC source but may be powered at a wide variety of voltages and frequencies, if desired. The strips may be of any desired length and may be placed upon flat or curved surfaces without effecting their ruggedness, light intensity and useful operating life.

FIG. 7 shows an alterative embodiment of the lamp assembly in which the fabrication of film 20 of FIGS. 1–3 is substantially eliminated as will be described and wherein the layers 22*a* and 24 are formed as part of a film layer 40′, totally eliminating plastic substrate 22*b* and adhesive 46. Noting, FIG. 7, film 40′ is modified from film 40 of FIG. 1 by application of the phosphor coating 22*a* directly upon the back electrode 44, in turn carried on substrate 42. The adhesive layer 46 employed in layer 40 of FIG. 1 is eliminated, and conductive layer 24 is applied directly upon phosphor layer 22*a*.

The modified structure of FIG. 7 eliminates the need for a separate film 20 and hence eliminates the preparation of film 20 per se and also reduces the total number of process steps. Layer 30 of FIG. 7 is formed using the same materials and process steps as layer 30 of FIG. 1. Layer 40′ requires the performance of the additional steps of forming a phosphor layer 22*a* upon the back electrode 44 and forming the conductive layer 24 upon phosphor layer 22*a*. However, the step of applying adhesive layer 46 in the formation of film 40 (see FIG. 1) is eliminated. In addition, the plastic substrate 22*b* employed as part of film 20 (see FIG. 1) is totally eliminated, thereby reducing the overall cost of the laminated structure shown in FIG. 7 as compared with the laminated structure shown in FIG. 1. The finished product will be substantially the same in appearance, looking down upon the top surface as shown in FIG. 2, as the finished product of FIGS. 1–3. The major disadvantage of the embodiment shown in FIG. 7 resides in the fact that the most expensive layer of the laminated structure shown in FIG. 7 film 40′. In the event that there is any misregistration of the busbar 36 or back electrode 44 in the embodiment of FIG. 1, film 20 is nevertheless protected and will not result in an expensive waste of material. On the other hand, any misregistration problems in the formation of film 40′ will result in waste of the most expensive portions of the structure. Exertion of careful quality control in the formation of the films 30 and 40′ will significantly reduce such waste, making the embodiment of FIG. 7 a practical alternative to that shown in FIG. 1.

Figure 14:
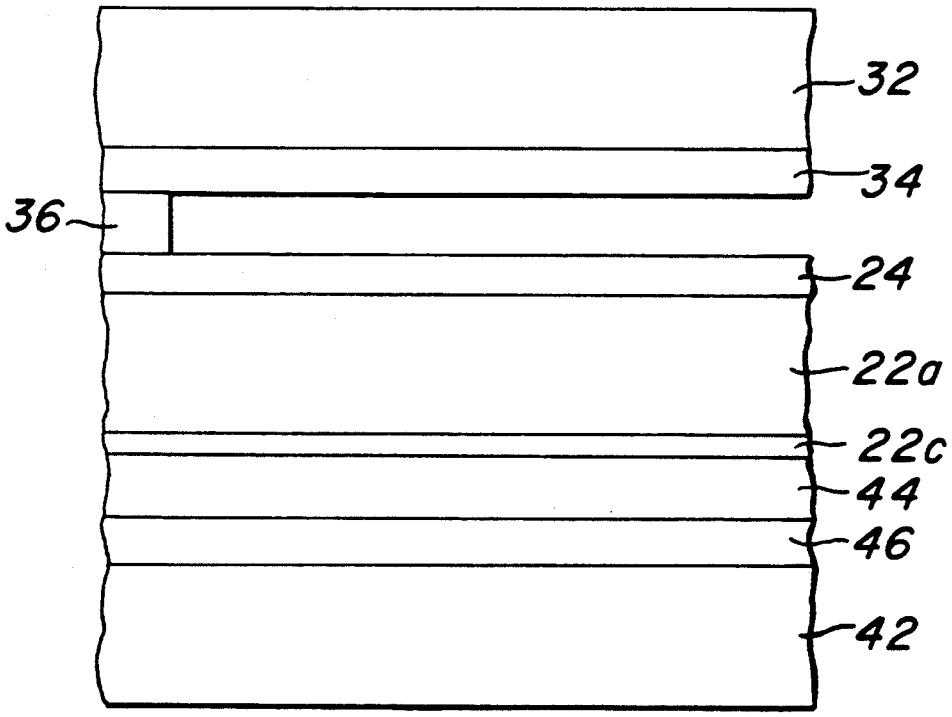
FIG. 14 is an enlarged, diagrammatic, partial end view of yet another preferred embodiment of this invention.

FIG. 14 represents an important variation of the aforesaid lamp structures in which a back electrode 44, which is preferably a metal foil, e.g., an aluminum or copper foil, about 0.001–0.030 in. thick, is contacted with a dielectric layer 22c. The dielectric layer may be a free-standing flexible film, but preferably, dielectric layer 22c is coated onto back electrode 44 from solution. The dielectric material may itself be or may contain an organic resin, but inorganic dielectric materials are advantageously incorporated into dielectric layer 22c. Suitable inorganic dielectric materials include metal oxides, such as zinc and titanium oxides, for example; or various metallic titanates, such as barium or strontium titanates, for example. A preferred inorganic dielectric material is barium titanate, which, for coating purposes, is advantageously mixed with the same resins employed in the electroluminescent phosphor layer as disclosed in U.S. Pat. No. 4,684,353, incorporated herein by reference. However, other resins, such as cyanoethylated resins, may be employed and are preferred in some applications. It is preferred that dielectric layer 22c be as thin as reasonably possible, e.g., about 20–100 microns thick when dried.

After application of dielectric layer 22c to back electrode 44, electroluminescent phosphor layer 22a and transparent conductor 24 are added, substantially as described hereinabove. Although busbar layer 36 can be added to the construction in other ways, it is convenient to coat busbar 36 directly upon transparent conductor 24. The lamp assembly is completed by securing flexible plastic substrates 32 and 42 to the assembly as shown in FIG. 14, either by including one or both of adhesive layers 34 and 46, or, preferably, by omitting layers 34 and 46. In the latter event, plastic substrates 32 and 42 are fused together by heat-laminating the entire assembly. For these purposes it is preferred that plastic substrates 32 and 42 be poly(haloethylene) films, such as ACLAR.

The laminated product shown in FIG. 7 or in FIG. 14 may be cut in a manner similar to that shown in FIG. 2 to produce individual lamp strips of any desired length and coupled to electrical power through the use of any of the aforementioned terminal connectors.

If desired, the completed laminated structure may be enclosed within suitable vapor barrier layers secured to opposite sides of the laminated lamp structure. One suitable vapor barrier material is known by the registered trademark ACLAR as described hereinabove; see U.S. Pat. No. 4,684,353. However, any other suitable vapor barrier layers may be employed.

FIGS. 9 through 13 show still other preferred embodiments of the present invention in which vapor deposited aluminum (VDAL) is employed for the material of the back electrode. Noting, for example, FIG. 9, film 30 is substantially identical to film 30 of FIG. 1. Film 40''' is comprised of a plastic substrate 42 and an adhesive layer 46. The light-emitting film 20'' is substantially the same as film 20 of FIG. 1 in that is includes conductive layer 24, phosphor layer 22a, and plastic substrate 22b. In addition thereto, a vapor deposited aluminum layer (VDAL) 70 is formed on the underside of substrate 22b. When VDAL is formed on the underside of layer 22b the protective film 40''' may be used.

Alternatively, film 40''' may be omitted, if desired. These layers are laminated together in the same manner as the layers of FIG. 1, adhesive layers 34 and 46 preferably being the heat sealable type.

Figure 10:
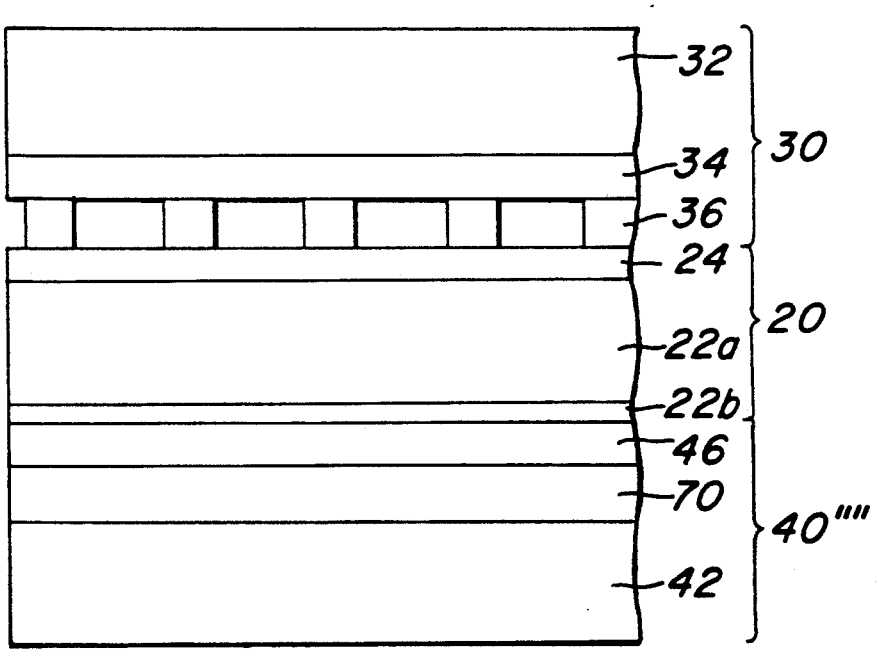

The structure of FIG. 10 more clearly resembles the embodiment of FIG. 1 in that films 30 and 20 are substantially the same as those shown in FIG. 1 and wherein the film 40'''' is formed by initially producing a VDAL layer 70 directly upon one surface of substrate 42 and then depositing an adhesive layer 46 upon the VDAL layer 70. The films of FIG. 10 are then laminated together in a manner similar to that described for FIG. 1.

Figure 9:
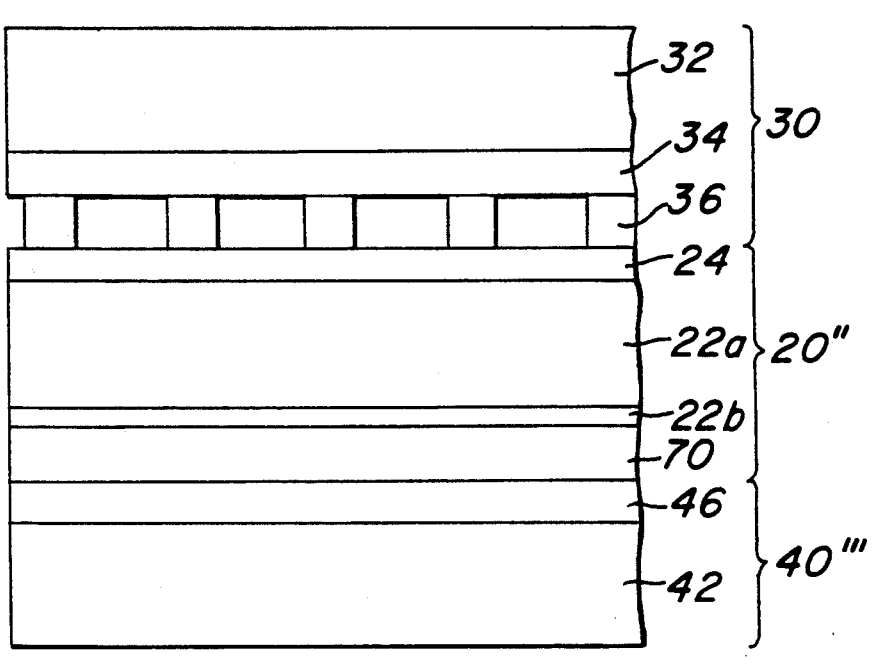
FIGS. 9 through 13 show enlarged, diagrammatic, partial end views of still other preferred embodiments of the present invention.
Figure 11:
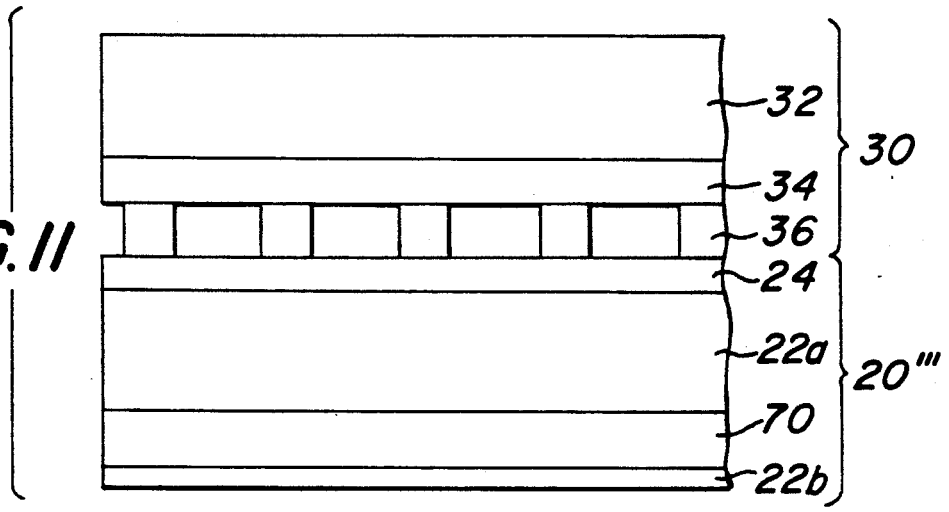

Film 30 of FIG. 11 is substantially identical to film 30 shown in FIG. 9. The intermediate and bottom films 20'' and 40''' of FIG. 9, for example, are substantially eliminated and replaced by a composite layer 20''' comprised of a VDAL layer 70 deposited upon plastic substrate 22b. In the embodiment of FIG. 11 the plastic substrate 22b is preferably 2 mils thick. A phosphor layer 22a is formed upon VDAL layer 70 and a conductive layer 24, e.g., either ITO (indium tin oxide) or IO (indium oxide), is deposited upon phosphor layer 22a. The films 20''' and 30 are laminated together using the preferred technique described hereinabove.

Figure 12:
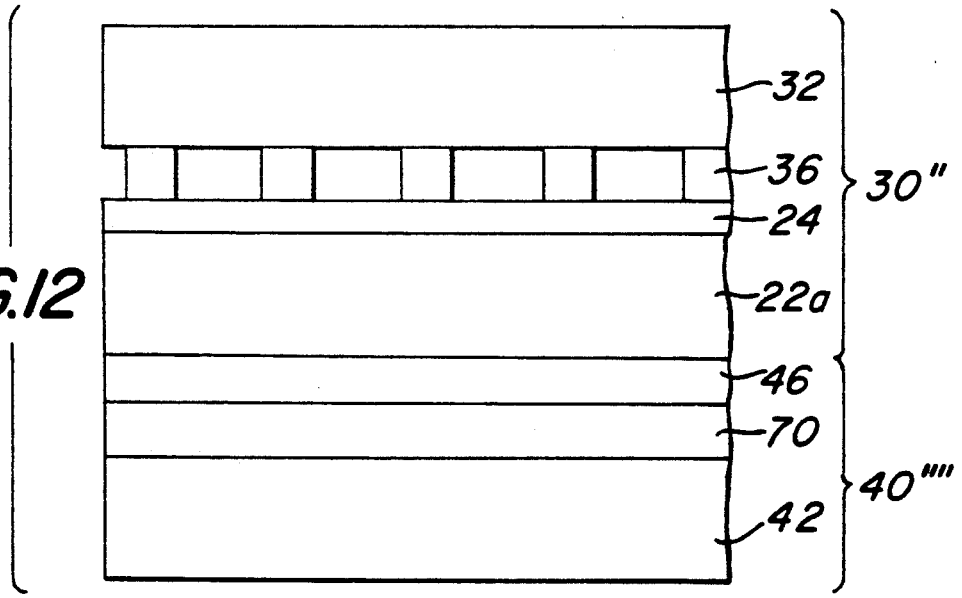

The structure of FIG. 12 comprises a layer 40'''' substantially identical to layer 40'''' of FIG. 10 in that it is comprised of plastic substrate 42, VDAL layer 70, and adhesive layer 46. A layer 30'' comprised of plastic substrate 32, busbars 36, ITO layer 24, which is formed by either a coating operation such as a gravure coating or sputter coating operation, and a phosphor layer 22a, is laminated to layer 40'''' using the preferred technique described above.

Figure 13:
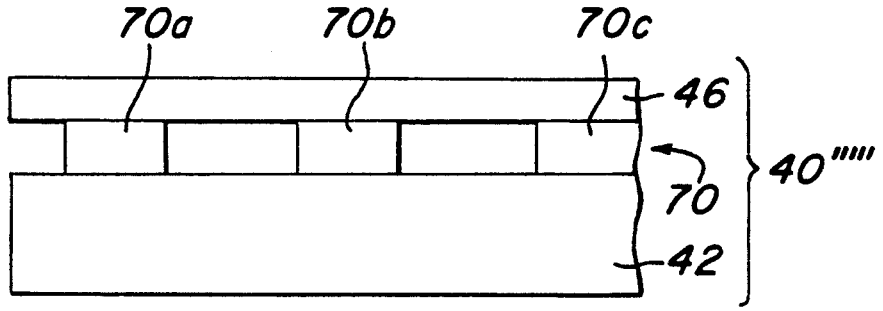

The VDAL layer may be a continuous, uniform layer as shown in FIGS. 9 through 12, or alternatively may be formed in elongated strips as shown by strips 70a, 70b, and 70c making up VDAL layer 70 of film 40''''' in FIG. 13, which layer 70 is arranged between plastic substrate 42 and adhesive layer 46. The VDAL layer of any of the embodiments in FIGS. 9 through 13 provides a back electrode of excellent conductivity while significantly reducing the material and processing costs as compared with those encountered in the production of the conductive ink back electrodes described above and especially the back electrodes formed using silver ink.

The transparent conductive coating 24 of any of the embodiments described also may be formed of VDAL of a thickness selected so as to allow at least a portion of the light emitted by the phosphor layer 22a to pass through the VDAL.

The VDAL may also be used as a busbar by forming VDAL upon a plastic substrate. The substrate is then cut into strips and laminated to a conductive transparent layer.

FIG. 4 shows still another embodiment of the present invention which is utilized for producing individual lamp structures, as opposed to a plurality of lamp strips described and shown, for example, in FIGS. 1–3, 7 and 14.

The film 30' of FIG. 4 differs from the film 30 shown in FIG. 1 in that a substantially J-shaped busbar 36' is formed on the underside of the plastic substrate 32a. Film 30' further may also include an adhesive layer, not shown for purposes of simplicity, but which is substantially the same as adhesive layer 34 shown in FIG. 1.

Film 40'' of FIG. 4 differs from films 40 and 40' of FIGS. 1 and 7, respectively, in that the back electrode 44' is provided with an integral trace or tail T2 electrically connected with the back electrode and extending toward the right-hand edge 42*a* of plastic substrate 42. A tail T1 is arranged in spaced parallel fashion with tail T2. Film 40" may be further provided with an adhesive layer, not shown in FIG. 4 for purposes of simplicity, but which is substantially the same as the adhesive layer 46 employed, for example, in the embodiment of FIG. 1.

The substrates 32 and 42 of films 30' and 40" are further provided with alignment holes 32*b* and 42*b*, respectively, pairs of said alignment holes preferably being arranged on opposite sides of the electrodes 36' and 44' in the manner shown. The films 20, 30' and 40" are positioned upon an assembly jig 60 comprising a surface 62 having a plurality of registration pins 64 adapted to extend through the registration openings 32*b* and 42*b* in order to place layers 30' and 40", and specifically the busbar and back electrode, in proper registration. Film 40" is placed upon surface 62 with openings 42*b* each receiving one of the associated pins 64.

Film 20 (see FIG. 1) is then placed upon the top surface of layer 40" so that its left-hand edge 20*a* rests against stop 66 provided upon surface 62. The width W of layer 20 is preferably just slightly less then the distance D3 between the pins 64 arranged along opposite longitudinal sides of surface 62. Positioning of film 20 relative to layer 40" (as well as layer 30') is not critical for the reasons set forth hereinabove so long as film 20 is substantially coextensive with the front and back electrodes 36' and 44'.

Finally, film 30' is placed upon film 20 so that each of its openings 32*b* receives one of the associated pins 64. The films are now in proper alignment.

FIG. 4*a* shows a top plan view of the films 30', 20 and 40" mounted upon the alignment pins and in proper registry. Tail T1 electrically engages the right hand portion 36*a*' of busbar 36'. If desired, the films may be placed upon the alignment pins in the reverse order, i.e. film 30' first; then film 20, then film 40". The films are laminated together utilizing, for example, a platen provided with alignment holes, each receiving one of the associated alignment pins 64. The platen may be pressed downwardly upon the assembly. Either the platen or surface 62 may be heated by suitable heating means to a temperature, preferably in a range between about 100° and about 350° F. to activate the heat sealable adhesive or resin. The above procedure may be semi- or fully automated for a continuous web operation.

Figure 8:
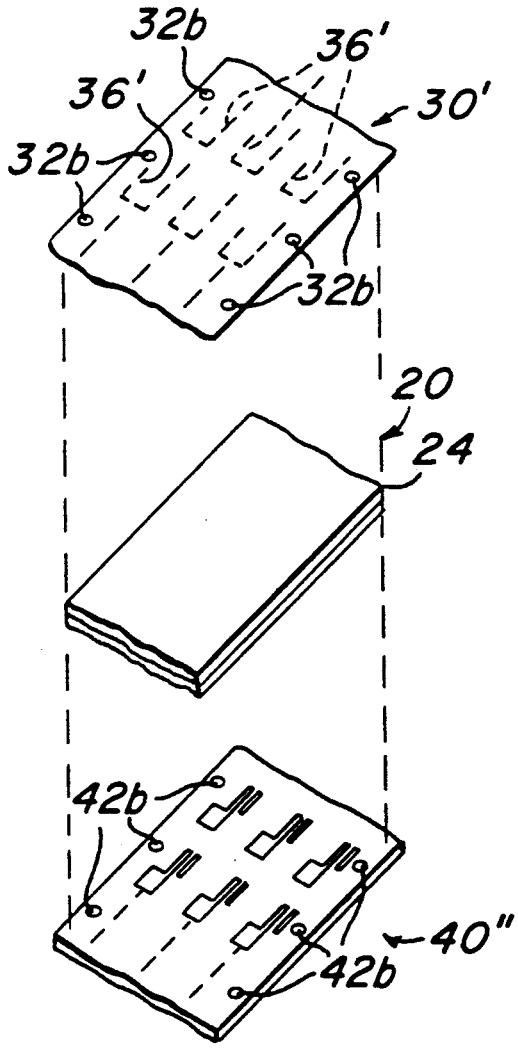
FIG. 8 is an exploded isometric view of still another embodiment of the present invention.

Noting FIG. 8, films 30' and 40" of FIG. 4, may be elongated webs provided with alignment openings 32*b*, 42*b* arranged in the longitudinal sides of the elongated webs at regularly spaced intervals. One of the rollers 56, 58 (see FIG. 6) may be provided with alignment pins 58*a*, for example, which enter into cooperating openings (not shown) in roller 56 and which enter the alignment openings in films 30', 40" to maintain the busbars and back electrodes in registry. The light emitting film 20 (FIG. 8) has a width slightly less than the spacing between the alignment pins. The nip may be heated to activate heat sealing resin(s). The finished lamp assemblies may then undergo a die cutting operation, which may also be an assembly of cooperating rollers located downstream relative to the laminating nip and the drying station.

Alternatively, the films may be advanced by pinch rollers engaging the opposite longitudinal sides of the films to be laminated. Optical means (not shown) can detect registration marks and halt feeding of the films through the laminating nip if a misregistration condition is detected.

The films may be sealed in the above manner and then die cut. The die cutting may be either a separate process step or may be incorporated in the heat sealing operation, for example, by providing a suitable groove in surface 62 (FIG. 4) for receiving a cutting edge, said cutting edge being of a rectangular shape for cutting away the unused outer marginal portion of the laminated structure. The traces or tails, aligned on the same side of the back electrode 44", provide optimum connector contact.

The laminant of FIGS. 4, 4*a* and 8 totally seals the phosphor, busbars, and back electrodes between plastic substrates 32 and 42 to protect these layers from contamination and oxidation. Traces T1 and T2 are preferably terminated at a point slightly inward from the edge E1 of the laminated structure shown in FIG. 4*a* in order to likewise be totally sealed. A puncture connector can then be aligned and pressed into position. The connector may, for example, be a Berg Clincher (TM) connector produced by DuPont. Alternatively, pressure-type or insertion-type connectors may be employed as suitable alternatives.

The technique just described eliminates the need for separate conductive tails employed in prior techniques, which are prepared in a separate operation, and which further require the application of an adhesive to be applied to and properly adhere the metal-to-metal contacts between the laminated structure of FIG. 4*a* and the aforementioned conductive tails.

The individual electroded films 30' and 40" may be produced one-at-a-time as in FIG. 4, or, alternatively, a plurality of the electrodes may be produced using a large plastic substrate having a plurality of electrode patterns arranged upon the sheet in a regular fashion as shown in FIG. 8. These patterns can then be individually cut out and assembled in the manner shown in FIGS. 4 and 4*a*. Alternatively, the sheets containing a plurality of the busbars and electrodes, respectively, may first be assembled together using a registration and alignment technique as shown in FIGS. 4 and 4*a*, whereupon all of the individual lamp structures are laminated in one operation and thereafter are separated into individual lamps by a cutting operation. The films 30' and 40" may be aligned using the alignment pins and cooperating alignment holes of FIGS. 4 and 4*a*, or an optical alignment technique if desired.

The advantages of the system employing films 30' and 40" in the embodiment shown in FIGS. 4 and 4*a*, as well as the embodiment shown in FIGS. 1–3 reside in the fact that any misregistration or any other errors encountered in the production of films 30 and 40 do not result in the expensive layer 20 being discarded due to the formation of a defective or misaligned busbar and/or electrode layer.

A latitude of modification, change and substitution is intended in the foregoing disclosure, and in some instances, some features of the invention will be employed without a corresponding use of other features. For example, the technique of FIGS. 4 and 4*a* may be used to laminate the films shown in FIGS. 7 and 14. Accordingly, it is appropriate that the appended claims be construed broadly and in a manner consistent with the spirit and scope of the invention herein described.

We claim:

1. A substantially continuous method for simultaneously producing a plurality of flexible electroluminescent lamp assemblies of the type including busbar, back electrode, and electroluminescent layers, said method characterized by:

(a) providing a first elongated flexible sheet having a plurality of elongated spaced substantially parallel back electrode layers disposed thereon;

(b) providing a second elongated flexible sheet having a plurality of elongated spaced substantially parallel busbar layers thereon, each of said busbar layers being substantially parallel with a corresponding one of said back electrode layers;

(c) providing an electroluminescent phosphor sheet having an overlying light-transmissive conductive layer and a dielectric layer on opposing surfaces of a phosphor material, and disposing said phosphor sheet between said first and second elongated flexible sheets;

(d) registering at least said first and second elongated flexible sheets so as to provide substantially continuous electrical contact between said back electrode and corresponding busbar layers; and (e) laminating at least said first and second elongated flexible sheets so as to provide a plurality of flexible electroluminscent lamp assemblies.

2. The method of claim 1, wherein said registering step comprises optically scanning an edge of said first or second elongated flexible sheet.

3. The method of claim 2, wherein said registration step comprises optically scanning at least said back electrode of said busbar layers.

4. The method of claim 3, wherein said registration step comprises providing mechanical alignment means for registering said first and second elongated flexible sheets.

5. The method of claim 4 wherein said back electrode layers comprise silver or vapor-deposited aluminum.

6. The method of claim 4 further comprising adhesive means for securing at least a pair of said sheets to one another.

7. A substantially continuous method for simultaneously producing a plurality of flexible electroluminescent lamp assemblies of indefinite length comprising the steps of:

providing a first film comprising a electroluminescent material disposed between a dielectric layer and a first light-transmissive layer;

applying to said first light-transmissive layer a second film which includes a busbar layer arranged on a second light-transmissive layer;

providing a back electrode layer;

providing a third film which includes a third plastic layer; and laminating said first, second and third films together with said busbar layer contacting said first light-transmissive layer of said first film and said back electrode layer contacting both the dielectric layer of said first film and said third plastic layer.

8. The method of claim 7, wherein the area of said first film which becomes illuminated is controlled by depositing the back electrode layer upon said third plastic layer so as to have a predetermined shape.

9. The method of claim 7, which further comprises:

providing said first film by depositing an electroluminescent layer upon said dielectric layer; and then depositing said first light-transmissive layer upon said electroluminescent layer; and arranging said second flexible film with said busbar layer contacting said first light-transmissive layer.

10. The method of claim 8, wherein said first light-transmissive layer is substantially conductive.

11. The method of claim 7, wherein each of said first, second, and third films comprises an elongated polymeric sheet; and said busbar and back electrode layers each comprise a plurality of elongated spaced substantially parallel conductors extending along the length of said polymeric sheets corresponding to said second and third films.

12. The method of claim 7, wherein said busbar and back electrode layers are non-overlapping.

13. The method of claim 7 which further comprises applying said dielectric layer to said back electrode prior to depositing said electroluminescent material.

14. A method for simultaneously producing a plurality of flexible lamp assemblies of indefinite length, which method comprises:

depositing an electroluminescent material upon one surface of a flexible dielectric layer;

depositing a first light-transmissive layer upon said electroluminescent material, thereby providing a first film which substantially encapsulates and protects said electroluminescent material;

depositing a conductive busbar on a second light-transmissive layer, thereby providing a second film;

depositing a conductive back electrode layer of a predetermined shape upon a second surface of said flexible dielectric layer;

positioning said first film between said second film and a polymeric backing film with the busbar engaging the first light-transmissive layer and the back electrode engaging the polymeric backing film; and laminating said first, second and polymeric backing films together.

15. The method of claim 14, wherein said back electrode comprises vapor-deposited aluminum.

* * * * *

UNITED STATES PATENT AND TRADEMARK OFFICE

CERTIFICATE OF CORRECTION

PATENT NO. : 5,184,969

DATED : February 9, 1993

INVENTOR(S) : Edward N. Sharpless, Eugene W. McManus

It is certified that error appears in the above-identified patent and that said Letters Patent is hereby corrected as shown below:

Col. 1, line 19, after "known" and before "the" insert --in--

Col. 1, line 50, change "objection" to --objective--

Col. 10, line 60, after "Fig. 7" and before "film" insert --is--

Col. 15, line 29 (Claim 3, line 3), change "of" to --or--

Signed and Sealed this

Twenty-eighth Day of December, 1993

*Attest:*

Bruce Lehman

BRUCE LEHMAN

*Attesting Officer*

*Commissioner of Patents and Trademarks*